US011497276B2

(12) United States Patent
Chang et al.

(10) Patent No.: US 11,497,276 B2
(45) Date of Patent: Nov. 15, 2022

(54) SUPPORT MEMBERS FOR ARTICLES OF FOOTWEAR

(71) Applicant: NIKE, Inc., Beaverton, OR (US)

(72) Inventors: Leo S. Chang, Portland, OR (US); Derek Houng, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/815,709

(22) Filed: Mar. 11, 2020

(65) Prior Publication Data

US 2020/0288814 A1 Sep. 17, 2020

Related U.S. Application Data

(60) Provisional application No. 62/819,500, filed on Mar. 15, 2019.

(51) Int. Cl.
*A43B 23/02* (2006.01)

(52) U.S. Cl.
CPC ..... *A43B 23/0245* (2013.01); *A43B 23/0235* (2013.01); *A43B 23/0265* (2013.01)

(58) Field of Classification Search
CPC ..... A43B 23/0245; A43B 23/0265; A43B 23/0235; A43B 23/02; A43B 23/024; A43B 23/027; A43B 23/0205
USPC ..... 36/45, 51
See application file for complete search history.

(56) References Cited

U.S. PATENT DOCUMENTS 10,194,714 B2 * 2/2019 McGinnity ..... A43B 23/027
2011/0041359 A1 2/2011 Dojan et al.
2013/0055590 A1 * 3/2013 Mokos ..... A43B 23/0265 36/45
2013/0219600 A1 * 8/2013 Atorrasagasti ..... B32B 5/022 2/463
2014/0377488 A1 * 12/2014 Jamison ..... D04C 1/10 428/221
2015/0208762 A1 7/2015 Reinhardt et al.
2017/0020231 A1 1/2017 Hausmann et al.
2017/0280826 A1 10/2017 Farris et al.
2018/0263338 A1 * 9/2018 Amis ..... A43B 23/0215
(Continued)

FOREIGN PATENT DOCUMENTS

CN 107708468 2/2018
EP 2938218 A2 11/2015

OTHER PUBLICATIONS

International Search Report and Written Opinion issued in International Application No. PCT/US2020/021988, dated Jun. 23, 2020, 14 pages.

*Primary Examiner* — Jameson D Collier
*Assistant Examiner* — Matthew R Marchewka
(74) *Attorney, Agent, or Firm* — Klarquist Sparkman, LLP

(57) ABSTRACT

An article of footwear includes a sole structure and an upper coupled to the sole structure. The upper includes a base layer and a plurality of support members. The base layer has a peripheral portion. The support members have end portions and an intermediate portion extending between the end portions. The end portions of the support members are coupled to the peripheral portion of the base layer. Each of the intermediate portions of the support members intersect with one or more other ones of the support members and is independently movable between a relaxed state and an engaged state relative to the one or more other ones of the support members.

18 Claims, 14 Drawing Sheets

(56) References Cited

U.S. PATENT DOCUMENTS

| | | | | |
|---|---|---|---|---|
| 2018/0271216 | A1 | 9/2018 | La O' et al. | |
| 2019/0017205 | A1 | 1/2019 | Luedecke et al. | |
| 2019/0110557 | A1* | 4/2019 | Hobson | A43B 23/0285 |
| 2019/0307208 | A1* | 10/2019 | Corcoran-Tadd | A43B 13/14 |
| 2020/0008526 | A1* | 1/2020 | Luedecke | D05C 17/00 |

* cited by examiner

SUPPORT MEMBERS FOR ARTICLES OF FOOTWEAR

CROSS-REFERENCE TO RELATED APPLICATION

This application claims priority to U.S. Provisional Application No. 62/819,500, filed on Mar. 15, 2019, which is incorporated by reference herein.

FIELD

This disclosure relates generally to articles of footwear and more particularly to uppers for articles of footwear.

BACKGROUND

An article of footwear (also referred to herein as "article") typically includes two main components: a sole structure and an upper. The sole structure is configured for supporting the wearer's foot and providing cushioning between the wearer's foot and the ground. The upper is coupled to the sole structure and is configured for securing the wearer's foot to the sole structure.

DETAILED DESCRIPTION

General Considerations

Figure 1:
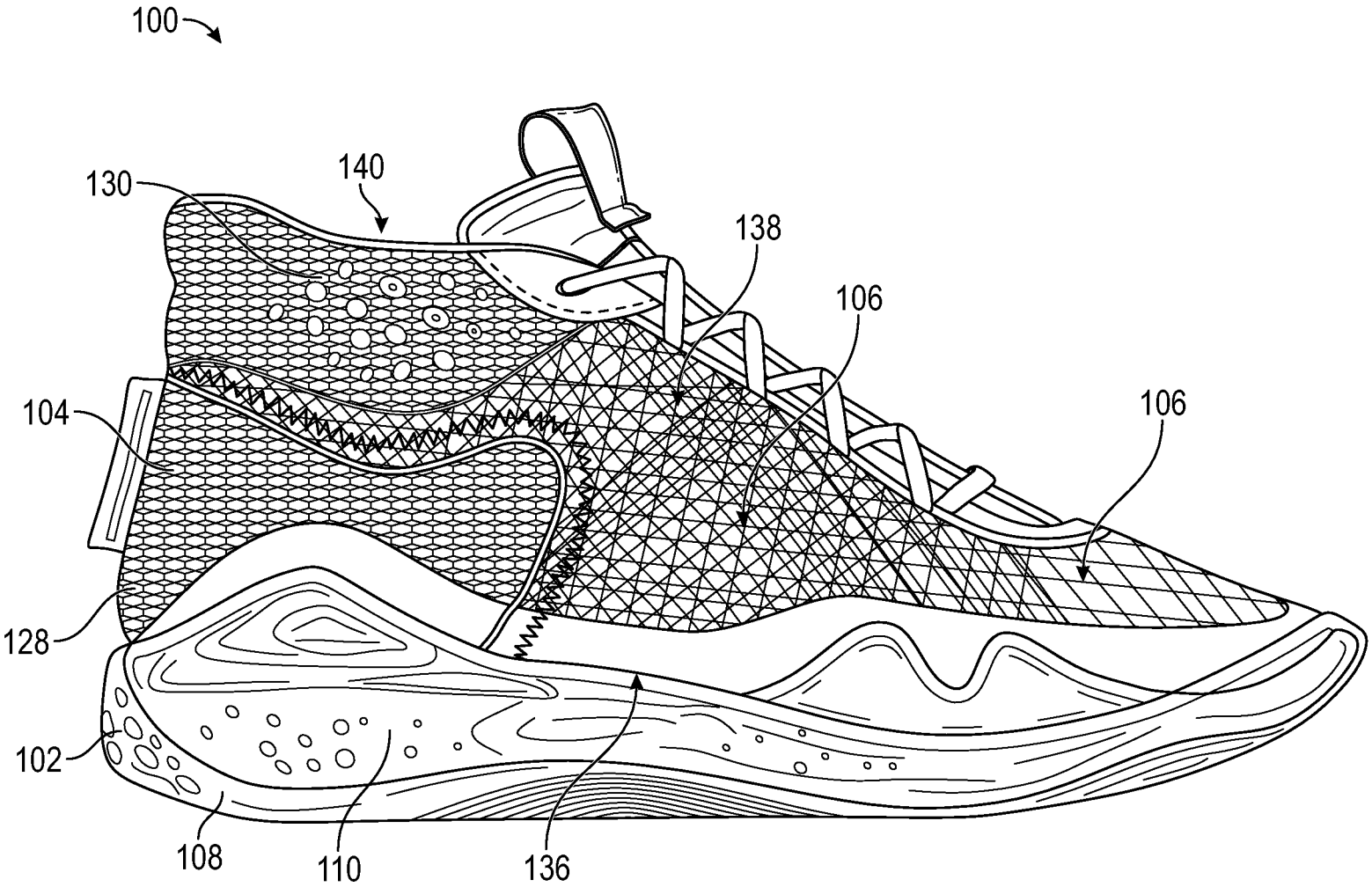
FIG. 1 is a side elevation view of an exemplary article of footwear.

The systems and methods described herein, and individual components thereof, should not be construed as being limited to the particular uses or systems described herein in any way. Instead, this disclosure is directed toward all novel and non-obvious features and aspects of the various disclosed embodiments, alone and in various combinations and subcombinations with one another. For example, any features or aspects of the disclosed embodiments can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present or problems be solved.

As used in this application the singular forms "a," "an," and "the" include the plural forms unless the context clearly dictates otherwise. Additionally, the term "includes" means "comprises." Further, the term "coupled" or "secured" encompasses mechanical and chemical couplings, as well as other practical ways of coupling or linking items together, and does not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

As used herein, the term "exemplary" means serving as a non-limiting example, instance, or illustration. As used herein, the terms "e.g.," and "for example," introduce a list of one or more non-limiting embodiments, examples, instances, and/or illustrations.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and methods. Additionally, the description sometimes uses terms like "provide" and "produce" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

As used herein, the directional terms (e.g., "upper" and "lower") generally correspond to the orientation of an article of footwear or sole assembly as it is configured to be worn by a wearer. For example, an "upwardly-facing surface" and/or an "upper surface" of a sole assembly refers to the surface oriented in the "superior" anatomical direction (i.e., toward the head of a wearer) when the article of footwear is being worn by the wearer. Similarly, the directional terms "downwardly" and/or "lower" refer to the anatomical direction "inferior" (i.e., toward the ground and away from the head of the wearer). "Front" means "anterior" (e.g., towards the toes), and "rear" means "posterior" (e.g., towards the heel). "Medial" means "toward the midline of the body," and "lateral" means "away from the midline of the body." "Longitudinal axis" refers to a centerline of the article from the heel to toe. Similarly, a "longitudinal length" refers to a length of the article along the longitudinal axis and a "longitudinal direction" refers to a direction along the longitudinal axis.

As used herein, the term "sole structure" refers to any combination of materials that provides support for a wearer's foot and bears the surface that is in direct contact with the ground or playing surface, such as, for example, a single sole; a combination of an outsole and an inner sole; a combination of an outsole, a midsole, and an inner sole; and a combination of an outer covering, an outsole, a midsole and an inner sole.

As used herein, the terms "attached" and "coupled" generally mean physically connected or linked, which includes items that are directly attached/coupled and items that are attached/coupled with intermediate elements between the attached/coupled items, unless specifically stated to the contrary.

As used herein, the terms "fixedly attached" and "fixedly coupled" refer to two components joined in a manner such that the components may not be readily separated from one another without destroying and/or damaging one or both of the components. Exemplary modalities of fixed attachment may include joining with permanent adhesive, stitches, welding or other thermal bonding, and/or other joining techniques. In addition, two components may be "fixedly attached" or "fixedly coupled" by virtue of being integrally formed, for example, in a molding process. In contrast, the terms "temporarily attached," "temporarily coupled," or "temporarily fixed," refer to two components joined in a manner such that the components can be readily separated from one another to return to their separate, discrete forms without destroying and/or damaging either component. Exemplary modalities of temporary attachment may include removable stitches or other temporary joining techniques.

As used herein, the terms "articles of footwear" or "articles" mean any type of footwear, including, for example, running shoes, soccer shoes, football shoes, rugby shoes, basketball shoes, baseball shoes, sneakers, hiking boots, sandals, socks, etc.

Although the figures may illustrate an article of footwear intended for use on only one foot (e.g., a right foot) of a wearer, one skilled in the art and having the benefit of this disclosure will recognize that a corresponding article of footwear for the other foot (e.g., a left foot) would be a mirror image of the right article of footwear.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, claims, abstract, and drawings.

The Disclosed Technology

An article of footwear typically includes two main components: a sole structure and an upper. The sole structure is configured for supporting the wearer's foot and providing cushioning between the wearer's foot and the ground. The upper is coupled to the sole structure and forms a foot-receiving cavity. The upper is configured for securing the wearer's foot to the sole structure and/or can protect the wearer's foot.

In use, a wearer's foot applies various forces to the sole structure and/or the upper. These forces can vary depending on the type of use and/or the physical characteristics (e.g., size, strength) of the wearer.

Typically, an upper of an article of footwear is made of one or more relatively thin, flexible materials. These materials allow the upper to bend and flex as the wearer moves and applies forces to the upper.

In some instances, it is desirable to allow one or more portions of the upper of an article to elastically deform (e.g., stretch) at least to some extent when forces are applied thereto. This can, for example, improve comfort. In other instances, it is desirable to limit or prevent one or more portions of the upper of the article from elastically deforming when forces are applied thereto. This can, for example, improve support and/or prevent the wearer's foot from slipping relative to the upper, the sole structure, and/or some other component of the article.

Due to the complex movements of a wearer's foot, it can be difficult to find the right balance of rigidity and stretchability. This difficulty is compounded in activities in which the wearer performs multiple types of movement. For example, when playing basketball, a wearer performs a number of complex movements, including running forward and backward, cutting side-to-side, jumping, pivoting, and stopping. Each of these movement exerts different types and magnitudes of forces on the article. Participants in other sports, such as tennis, soccer, football, baseball, volleyball, etc., move in similar but unique ways.

Thus, some shoes have an upper with rigidity/stretchability configured for one type of movement (e.g., running forward), but it may leave the upper too rigid for other types of movement (e.g., cutting side-to-side) and/or too stretchable for yet other types of movement (e.g., jumping). Some other shoes may have an overall rigidity/stretchability that is suitable for multiple movements, but they do allow for fully customized tuning in multiple directions.

Disclosed herein are articles of footwear that have an upper that can be fully customized in multiple directions and/or for multiple types of movement. As a result, the disclosed articles of footwear provide improved comfort, performance, and durability compared to typical shoes.

In one representative embodiment, an article of footwear includes a sole structure and an upper coupled to the sole structure. The upper includes a base layer and a plurality of support members. The base layer has a peripheral portion. The support members have end portions and an intermediate portion extending between the end portions. The end portions of the support members are coupled to the peripheral portion of the base layer. Each of the intermediate portions of the support members intersect with one or more other ones of the support members and is independently movable between a relaxed state and an engaged state relative to the one or more other ones of the support members.

In some embodiments, the plurality of support members includes a first plurality of support members oriented in a first axial direction, a second plurality of support members oriented in a second axial direction, a third plurality of support members oriented in a third axial direction, and a fourth plurality of support members oriented in a fourth axial direction, and the first axial direction, the second axial direction, the third axial direction, and the fourth axial direction intersect with each other.

In some embodiments, the first axial direction and the second axial direction intersect at an angle between 70-110 degrees. In some embodiments, the first axial direction and the second axial direction intersect at an angle between 80-100 degrees. In some embodiments, the first axial direction and the second axial direction intersect at an angle of 90 degrees.

In some embodiments, the third axial direction and the fourth axial direction intersect at an angle between 70-110 degrees. In some embodiments, the third axial direction and the fourth axial direction intersect at an angle between 80-100 degrees. In some embodiments, the third axial direction and the fourth axial direction intersect at an angle of 90 degrees.

In some embodiments, the first axial direction and the third axial direction intersect at an angle between 25-65 degrees. In some embodiments, the first axial direction and the third axial direction intersect at an angle between 25-55 degrees. In some embodiments, the first axial direction and the third axial direction intersect at an angle of 45 degrees.

In some embodiments, the first axial direction and the fourth axial direction intersect at an angle between 25-65 degrees. In some embodiments, the first axial direction and the fourth axial direction intersect at an angle between 25-55 degrees. In some embodiments, the first axial direction and the fourth axial direction intersect at an angle of 45 degrees.

In some embodiments, the support members are configured to limit elastic deformation of the base layer in one or more directions when the support members are in the engaged state.

In some embodiments, the upper further comprises a toe portion, and the base layer and the support members are disposed on the toe portion. In some embodiments, the upper further comprises a lateral side portion, and the base layer and the support members are disposed on the lateral side portion. In some embodiments, the upper further comprises a medial side portion, and the base layer and the support members are disposed on the medial side portion. In some embodiments, the upper further comprises a heel portion, and the base layer and the support members are disposed on the heel portion.

In some embodiments, the peripheral portion of the base layer includes a bite line portion and a vamp portion.

In another representative embodiment, an article of footwear includes a sole structure and an upper coupled to the sole structure. The upper includes a base layer and a plurality of support members. The base layer is elastically deformable when forces are applied thereto. The support members include fixed portions coupled to the base layer and floating portions movable relative to the base layer. The support members are independently movable between a relaxed state and an engaged state relative to the one or more other ones of the support members. The support members are configured to limit elastic deformation of the base layer when the support members are in the engaged state.

In some embodiments, the base layer is elastically deformable in a plurality of directions.

In some embodiments, the plurality of support members includes a first plurality of support members oriented in a first axial direction, and a second plurality of support members oriented in a second axial direction.

In some embodiments, each of the support members of the first plurality of support members is spaced apart relative to an adjacent support member of the first plurality of support members.

In some embodiments, each of the support members of the second plurality of support members is spaced apart relative to an adjacent support member of the second plurality of support members.

In some embodiments, the plurality of support members includes a first support member and a second support member. The first support member has a first tension in the relaxed state and a second tension in the engaged state. The second tension is greater than the first tension. The second support member has a third tension in the relaxed state and a fourth tension in the engaged state. The fourth tension is greater than the third tension.

In some embodiments, the first tension of the first support member is equal to the third tension of the second support member. In some embodiments, the first tension of the first support member is different than the third tension of the second support member. In some embodiments, the second tension of the first support member is equal to the fourth tension of the second support member. In some embodiments, the second tension of the first support member is different than the fourth tension of the second support member.

In some embodiments, the upper is configured such that when a first force is applied to the upper the first support member is in the engaged state and the second support member is in the relaxed state.

In some embodiments, the upper is configured such that when a second force is applied to the upper the first support member is in the relaxed state and the second support member is in the engaged state.

Additional examples of the disclosed technology are described below with reference to the accompanying drawings.

Exemplary Embodiments of the Disclosed Technology

Figure 2:
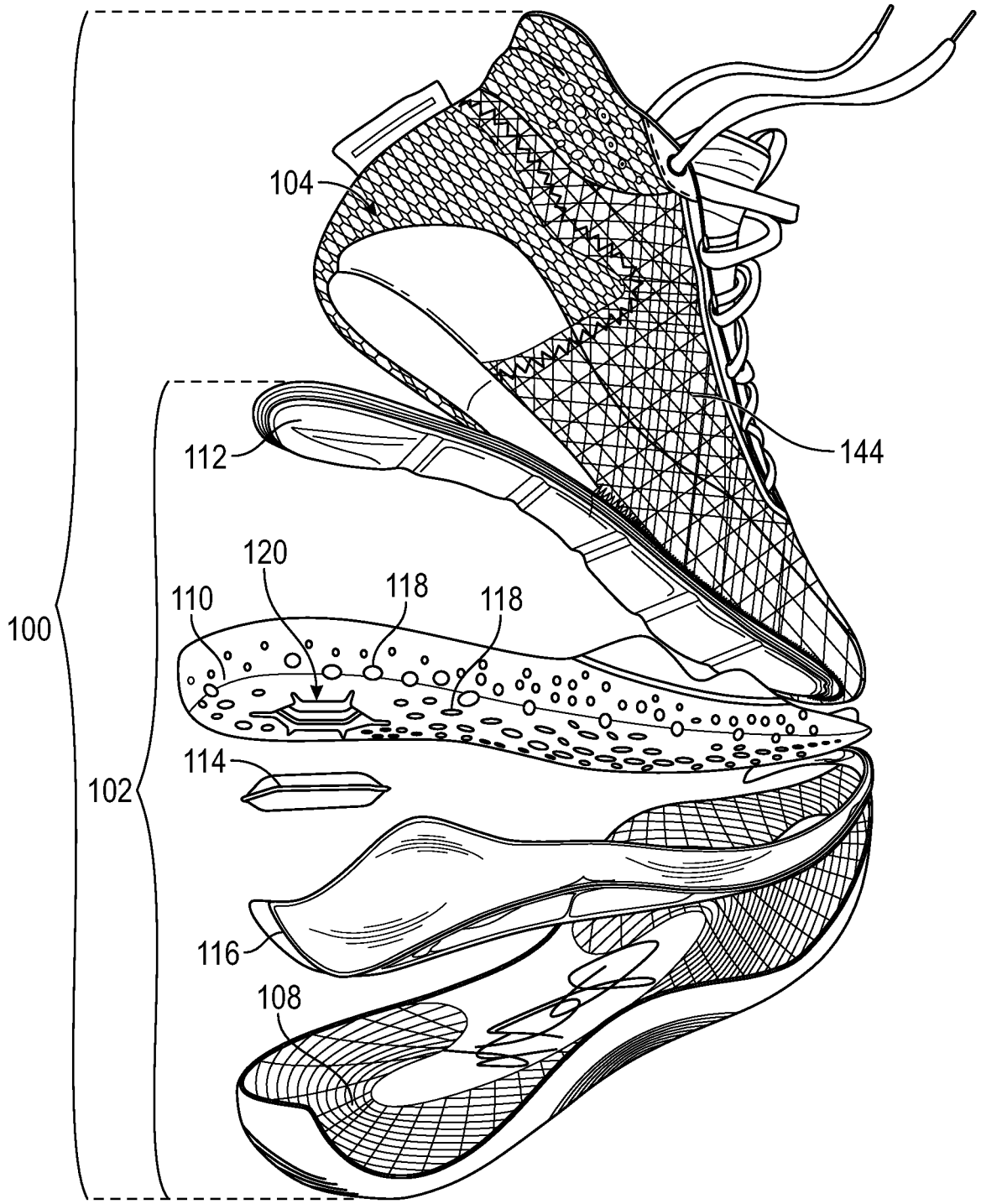
FIG. 2 is an exploded perspective view of the article of footwear.

FIGS. 1 and 2 show an article of footwear 100. Referring to FIG. 1, the article of footwear 100 comprises two main components: a sole structure 102 and an upper 104. The upper 104 is coupled to the sole structure so as to form a foot-receiving cavity between the sole structure 102 and the upper 104. As further described below, the upper 104 of the article of footwear 100 has a plurality of support members 106 (see FIGS. 5-14). The support members 106 can, for example, allow the upper of the article of footwear 100 to be fully customized in multiple directions and/or for multiple types of movement. This results in the article of footwear 100 providing, for example, improved comfort, performance, and durability compared to typical shoes.

Referring now to FIG. 2, the sole structure 102 comprises an outsole 108 and a midsole 110. In the illustrated embodiment, the outsole 108 and the midsole 110 are formed as separate components that are fixedly coupled together. In other embodiments, the outsole 108 and the midsole 110 can be integrally formed as a unitary component.

In some embodiments, the sole structure can also comprise one or more additional components. For example, in the illustrated embodiment, the sole structure 102 comprises a first cushioning element 112 (e.g., an fluid-filled capsule (e.g., an airbag) or foam member), a second cushioning element 114 (e.g., an fluid-filled capsule (e.g., an airbag) or foam member), and a stability member 116. In other embodiments, the sole structure can additional components (e.g., additional cushioning elements) and/or omit one or more of the components of the sole structure 102 (e.g., the first cushioning element 112 and/or the second cushioning element 114).

In the illustrated embodiment, the midsole 110 comprises perforations 118 and an opening 120 in the heel portion. The perforations 118 can, for example, reduce weight of the midsole 110. The perforations 118 can also allow the first cushioning element 112 to be visible from the bottom of the shoe in embodiments with an opaque or translucent outsole 108. The opening 120 can, for example, reduce the amount of material between the second cushioning element 114 and the wearer's foot, thereby improving the feel and/or responsiveness of the article of footwear 100.

Figure 3:
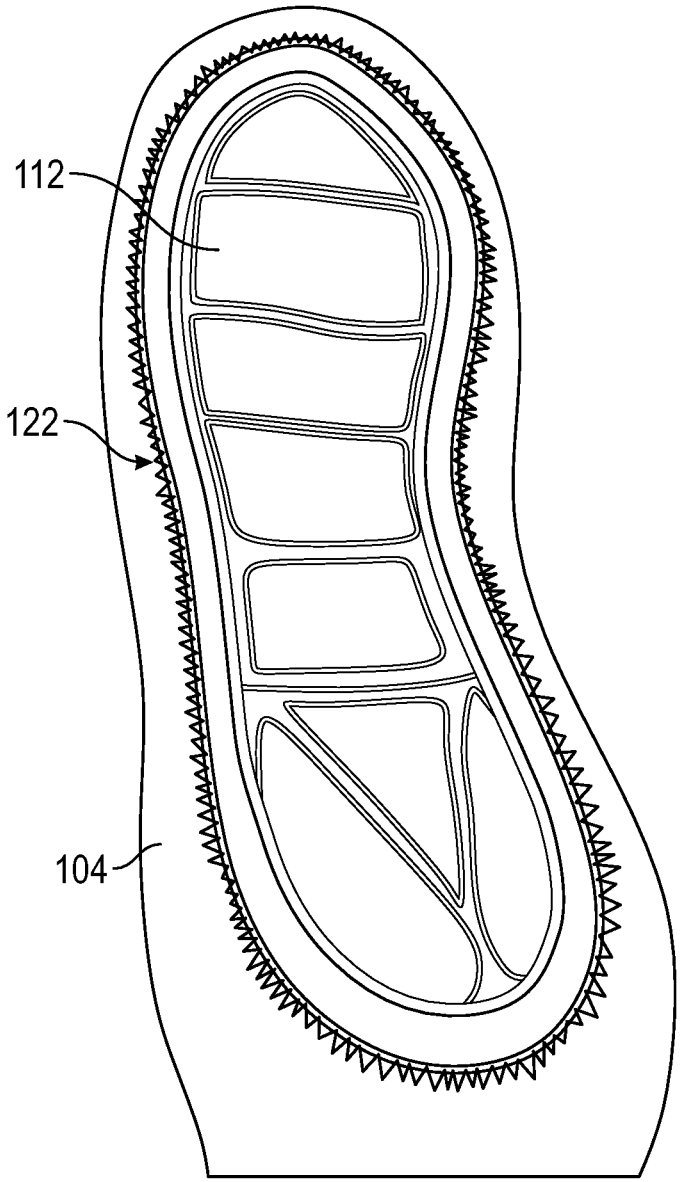
FIG. 3 is a perspective view of a bottom portion of an upper coupled to a cushioning element.
Figure 4:
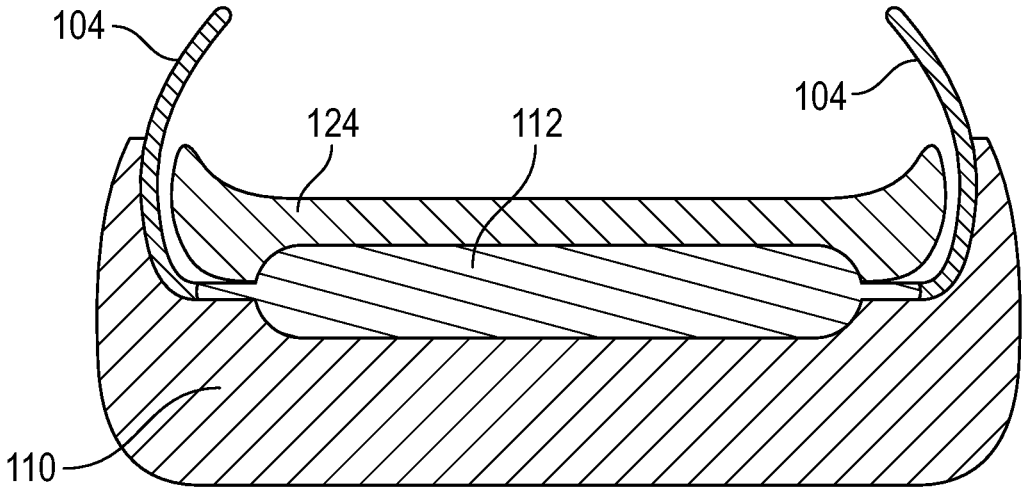
FIG. 4 is a cross-sectional view of the sole structure and the upper of the article of footwear.

The upper can be fixedly coupled to the sole structure in various ways. For example, in some embodiments, the upper can be attached (e.g., stitched) to a strobel, and the strobel can be attached to the midsole (e.g., with an adhesive). In other embodiments, the upper can be attached to a component of the sole structure. For example, as shown in FIG. 3, the upper 104 is attached directly to the first cushioning element 112 of the sole structure 102 via stitching 122. The first cushioning element 112 (and the other components of the sole structure 102) can be coupled together (e.g., via adhesive) and can form an assembly as shown in FIG. 4. In some embodiments, the article of footwear 100 can also comprise a sockliner 124 on top of the first cushioning element 112, as shown in FIG. 4.

Figure 5:
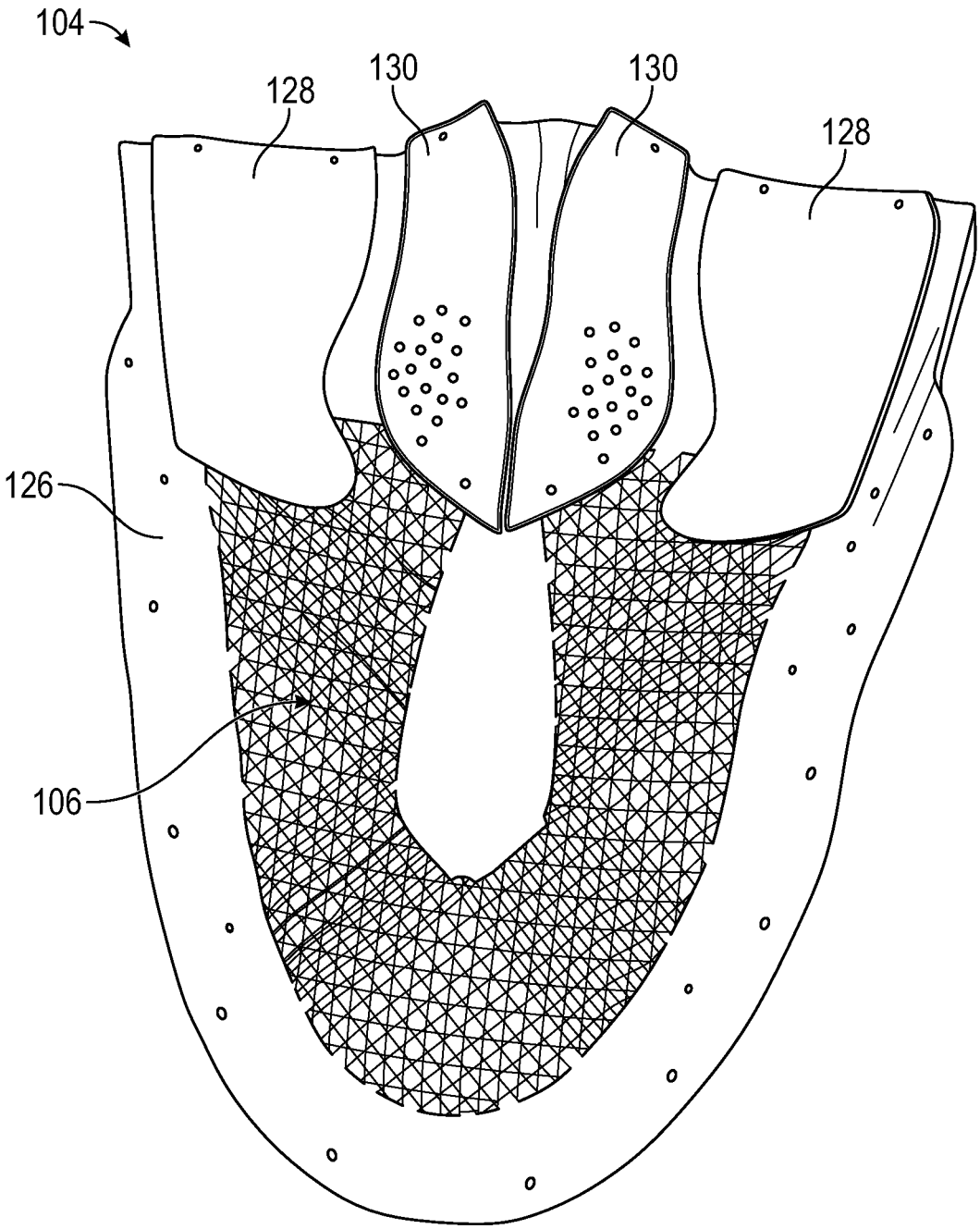
FIG. 5 is a plan view of an upper of the article of footwear, showing the outward-facing side of the upper.

FIGS. 5-14 show the upper 104. Referring to FIG. 5, the upper 104 can include two main components: a base layer 126 and the support members 106. The upper 104 also includes optional heel elements 128 and collar elements 130.

One or more portions of the support members 106 can be coupled to base layer 126 (e.g., stitched, adhered, etc.), as further explained below. The support members 106 can be used to customize the stretchability (e.g., elastic deformation) of the base layer 126 in one or more directions. This due to the fact the support members are relatively less stretchable (e.g., elastic) than the base layer 126.

The base layer 126 of the upper 104 can be relatively thin, stretchable material. In some embodiments, the base layer 126 can be configured to elongate to the same extent in a plurality of directions. In other words, when a force is applied to the base layer in a first direction (e.g., tension in the anterior/posterior direction) the base layer elongates in the first direction to the same extent as when the force is applied to the base layer in a second direction (e.g., tension in the medial/lateral direction). In other embodiments, the base layer 126 can be configured to elongate to a different extent in one direction than one or more other directions when the same force is applied the respective directions.

Figure 6:
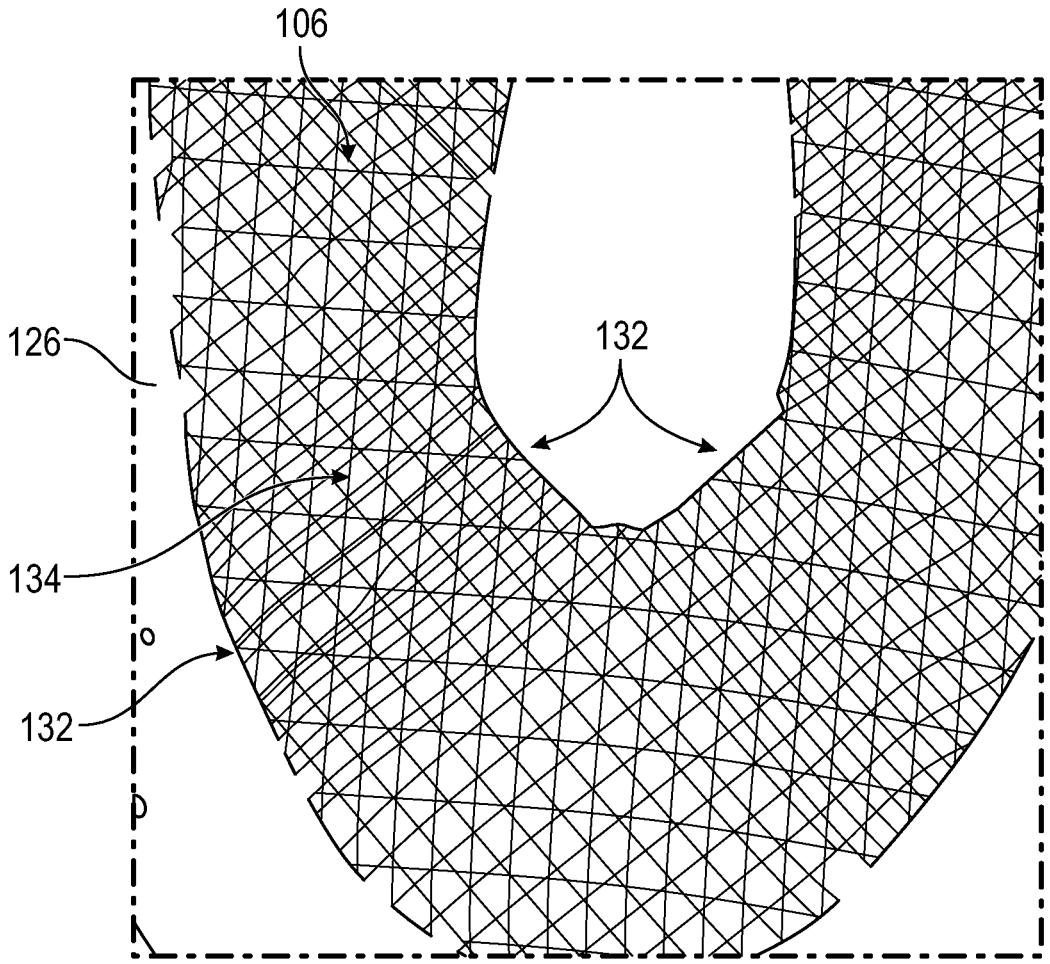
FIG. 6 is a detail view of the upper of the article of footwear, showing the outward-facing side of the upper.

As shown in FIG. 6, the support members 106 of the upper 104 comprise a plurality of strands that are interwoven with each other. Each support member 106 comprises end portions 132 and intermediate portions 134 disposed between the end portions 132. The end portions 132 are fixedly coupled to a peripheral portion (e.g., a boundary) of the base layer 126. In some instances, the end portions 132 can extend from a bite line portion 136 (FIG. 1, the portion where the upper and sole structure meet) of the upper 104 to a vamp portion 138 (FIG. 1, the portion adjacent the lace eyelets) or to a collar portion 140 (FIG. 1, the portion configured to be disposed around the wearer's ankle).

Figure 7:
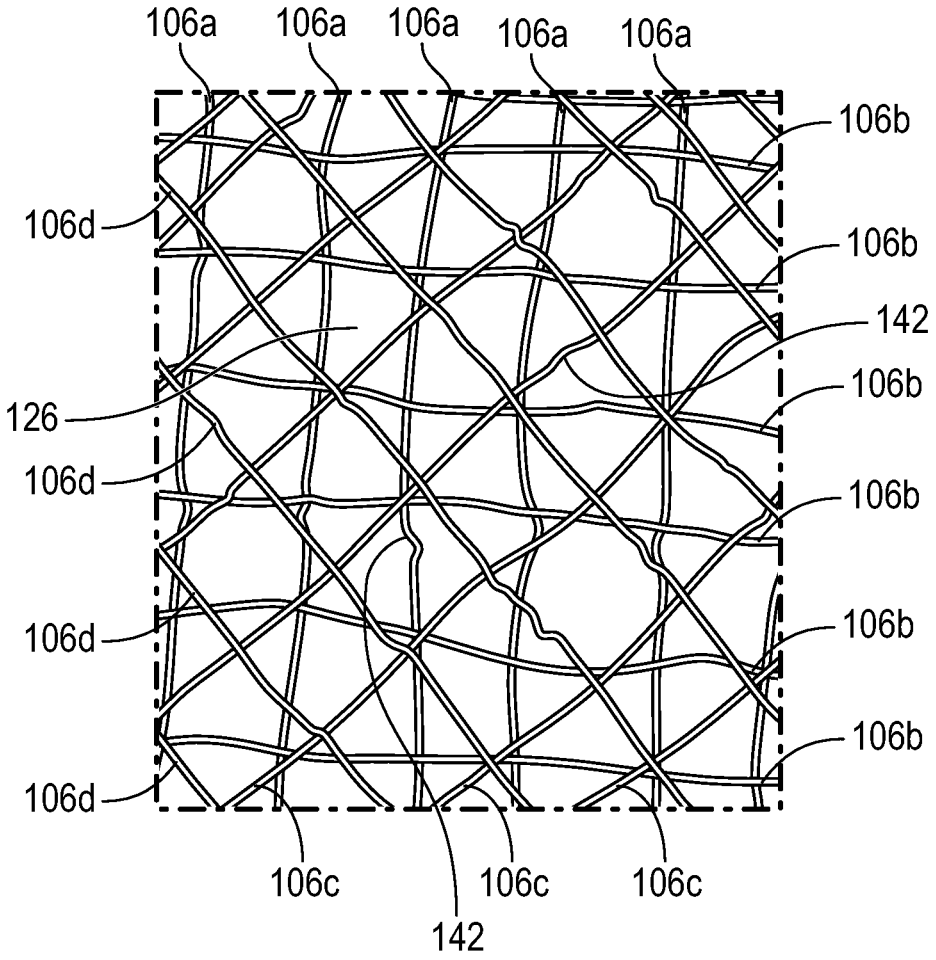
FIG. 7 is another detail view of the upper of the article of footwear, showing the outward-facing side of the upper.
Figure 8:
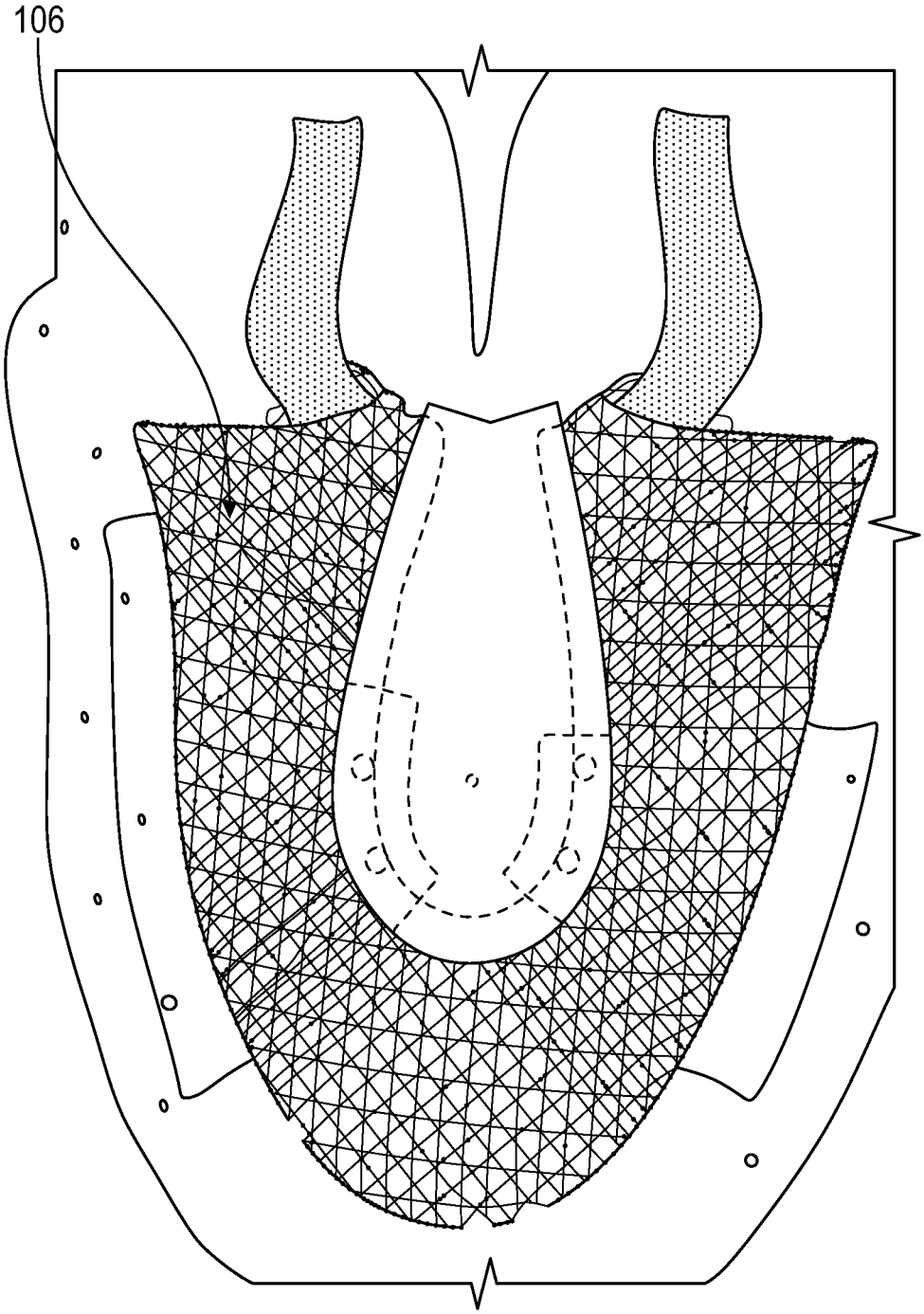
FIG. 8 is a detail view of the upper of the article of footwear, showing the inward-facing side of the upper.
Figure 9:
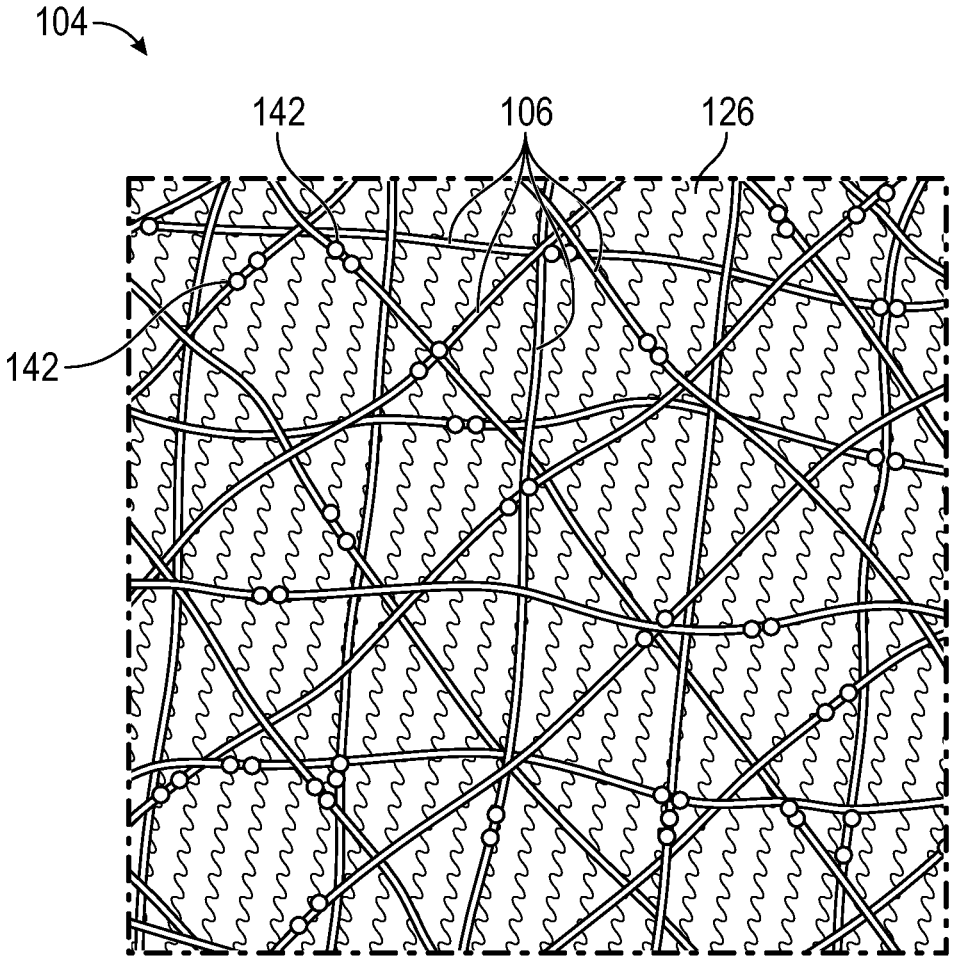
FIG. 9 is another detail view of the upper of the article of footwear, showing the inward-facing side of the upper.

In some instances, the intermediate portions 134 of the support members 106 can be completely uncoupled to the base layer 126. In other embodiments, the intermediate portions 134 of the support members 106 can comprise one or more tack stitches 142 (FIG. 7). The tack stiches can also be seen in FIGS. 8 and 9, which show an inner side of the upper 104. The tack stitches couple the intermediate portions 134 to the base layer 126.

Referring to FIG. 7, the support members 106 comprise a plurality of first strands 106*a* oriented in a first direction, a plurality of second strands 106*b* oriented in a second direction, a plurality of third strands 106*c* oriented in a third direction, and a plurality of fourth strands 106*d* oriented in a fourth direction. The strands 106*a*-106*d* are collectively referred to as the support members 106.

The strands 106*a*-106*d* intersect, but the strands can all move independently relative to each other. As one example, the first strands 106*a* can move independently relative to the second strands 106*b*, the third strands 106*c*, and the fourth strands 106*d*, and likewise for the other strands.

In some embodiments, when the upper 104 of the article of footwear 100 is not under any load or movement, one or more of the support members 106 can be in a relaxed state. In the relaxed state, the support members 106 are slackened, as shown in FIG. 7. When the article of footwear 100 is in motion and/or loads are applied to the upper 104, one or more of the support members 106 can move from the relaxed state to an engaged state. As the support members move from the relaxed state to the engaged state, the base layer 126 can stretch. Once the support members 106 reach the engaged state, one or more of the support members become taut, and thereby limit or prevent the base layer 126 from further stretching in the direction of the taut support members 106.

The tension of each strand of the support members 106 or each group of strands can be individually selected to customize the fit and performance of the upper 104. Also, the various properties (e.g., thickness, material, cross-sectional profile) of the support members can be individually selected to customize the fit and performance of the upper 104.

In some embodiments, the tension of one group of strands can be the same as one or more of the other groups of strands when the groups of strands are in the relaxed state. In this manner, the base layer 126 tends to elongate evenly in a plurality of directions (assuming the base layer 126 uniformly elongates without the support members 106 coupled thereto and that the strands have uniform properties). In other embodiments, the tension of one group of strands can be different than one or more other groups of strands. In this manner, the base layer 126 tends to elongate more in the direction where the strands have less tension in the relaxed state than in the direction in which the strands have more tension in the relaxed state (assuming the base layer 126 uniformly elongates without the support members 106 coupled thereto and that the strands have uniform properties).

If stretch is not desired in a particular direction, the support members 106 oriented in that direction can be in the engaged state when the article of footwear has no external forces applied thereto.

Figure 10:
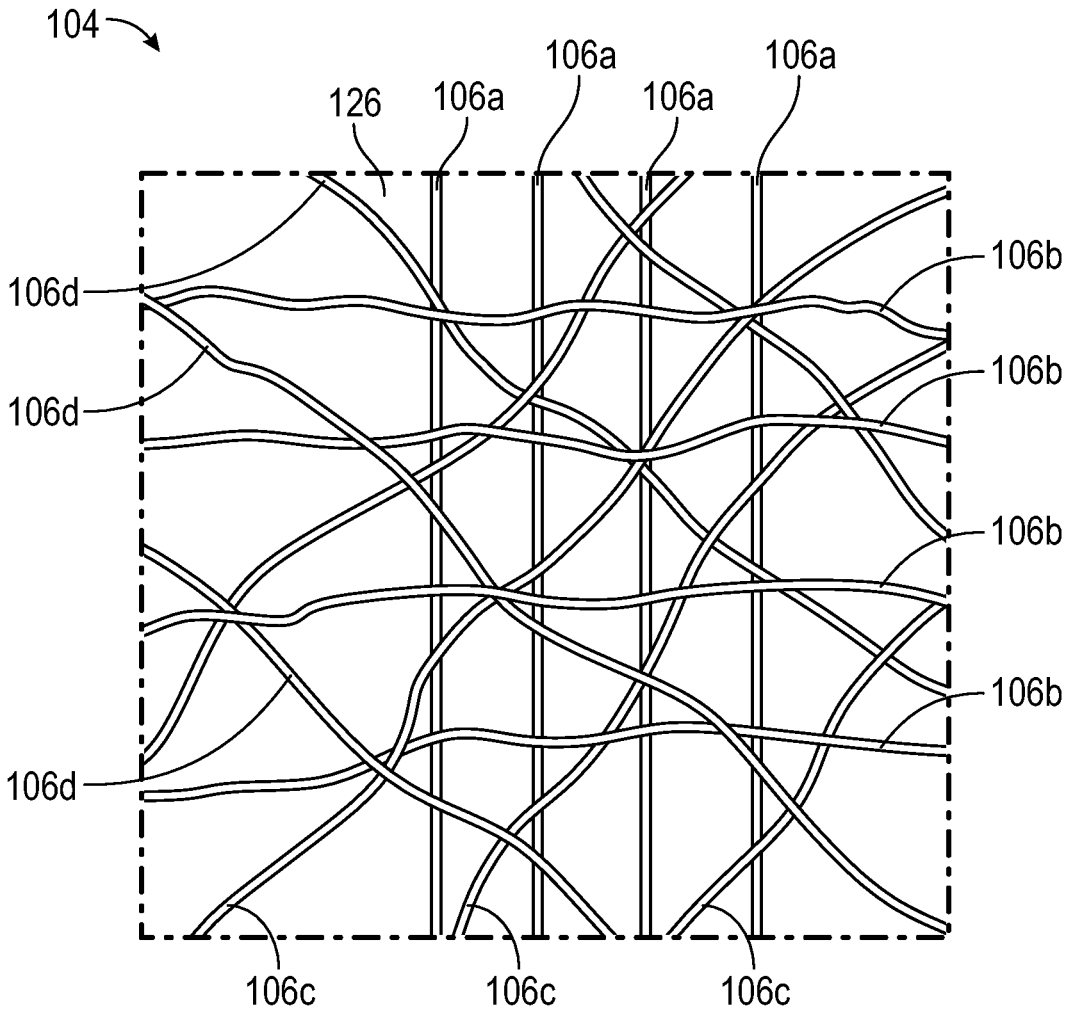
FIG. 10 is a detail view of the upper of the article of footwear, showing the upper with a first force applied thereto.
Figure 11:
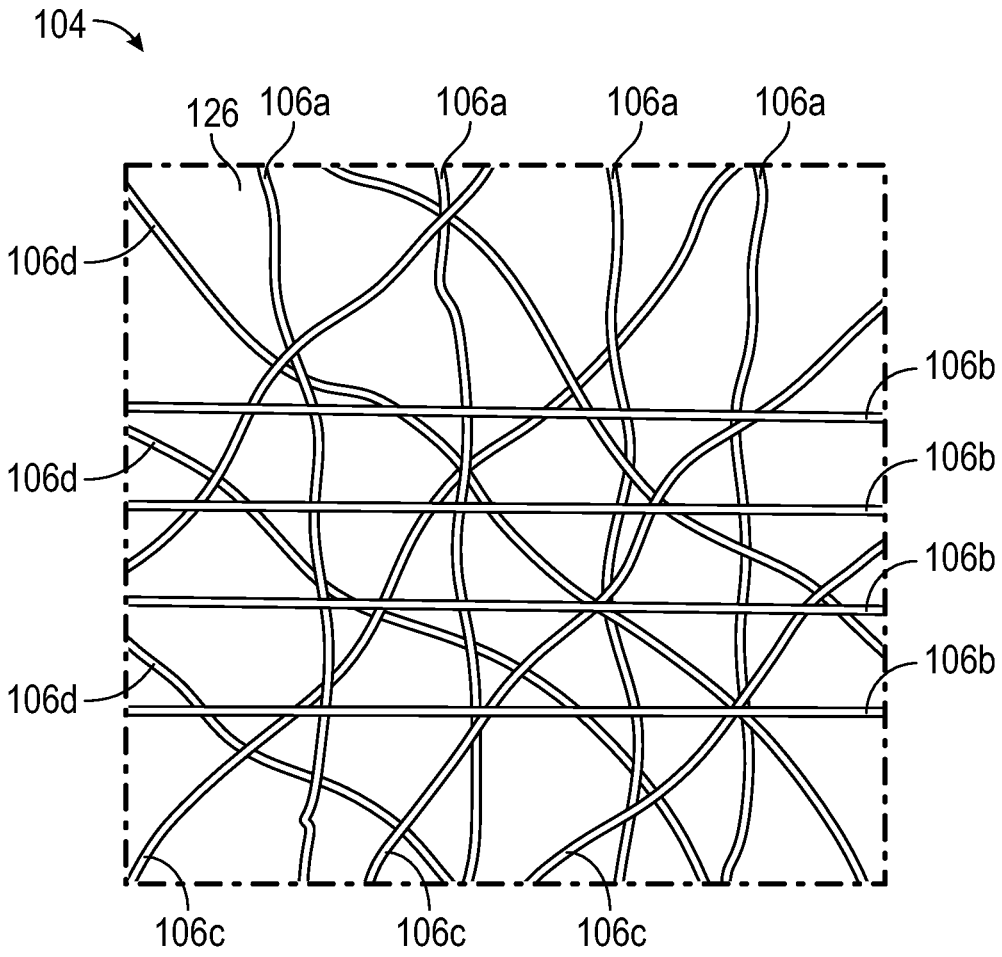
FIG. 11 is a detail view of the upper of the article of footwear, showing the upper with a second force applied thereto.
Figure 12:
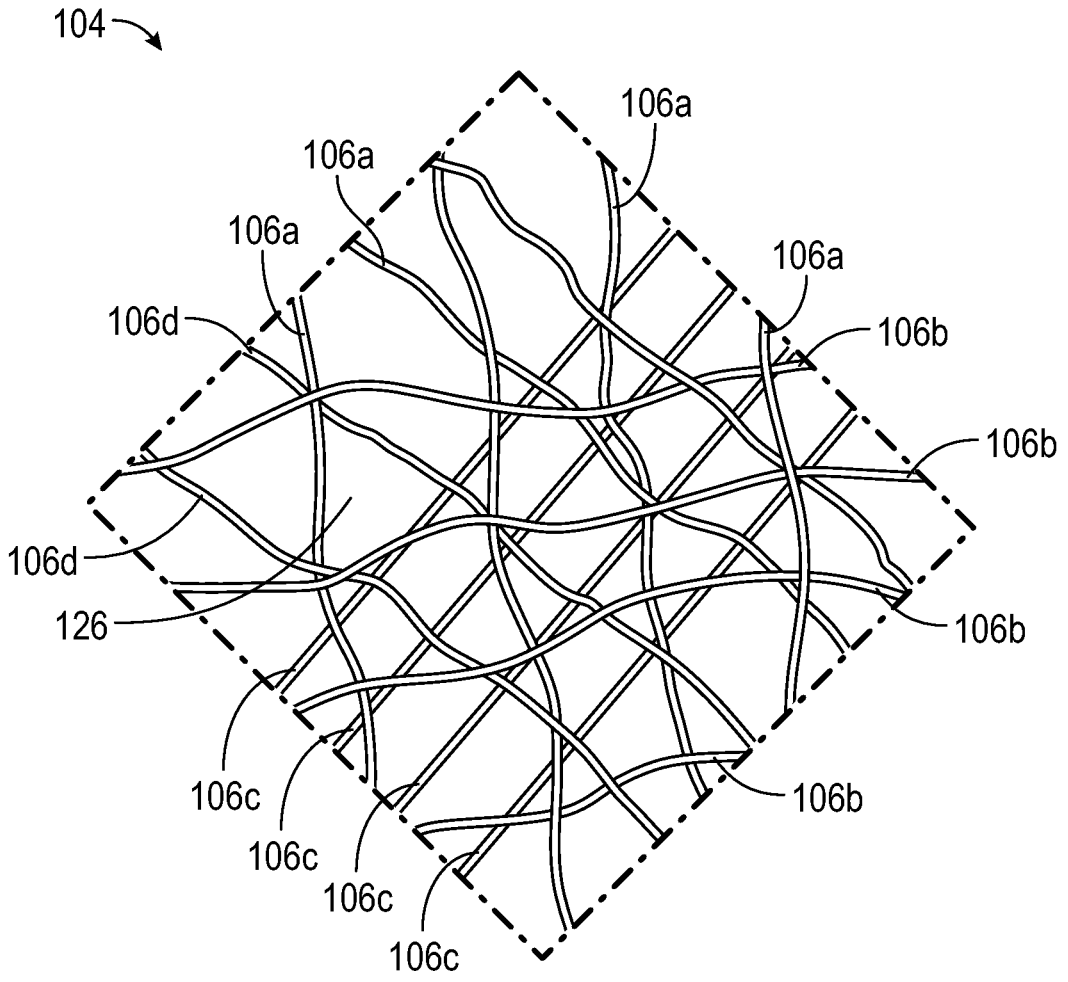
FIG. 12 is a detail view of the upper of the article of footwear, showing the upper with a third force applied thereto.
Figure 13:
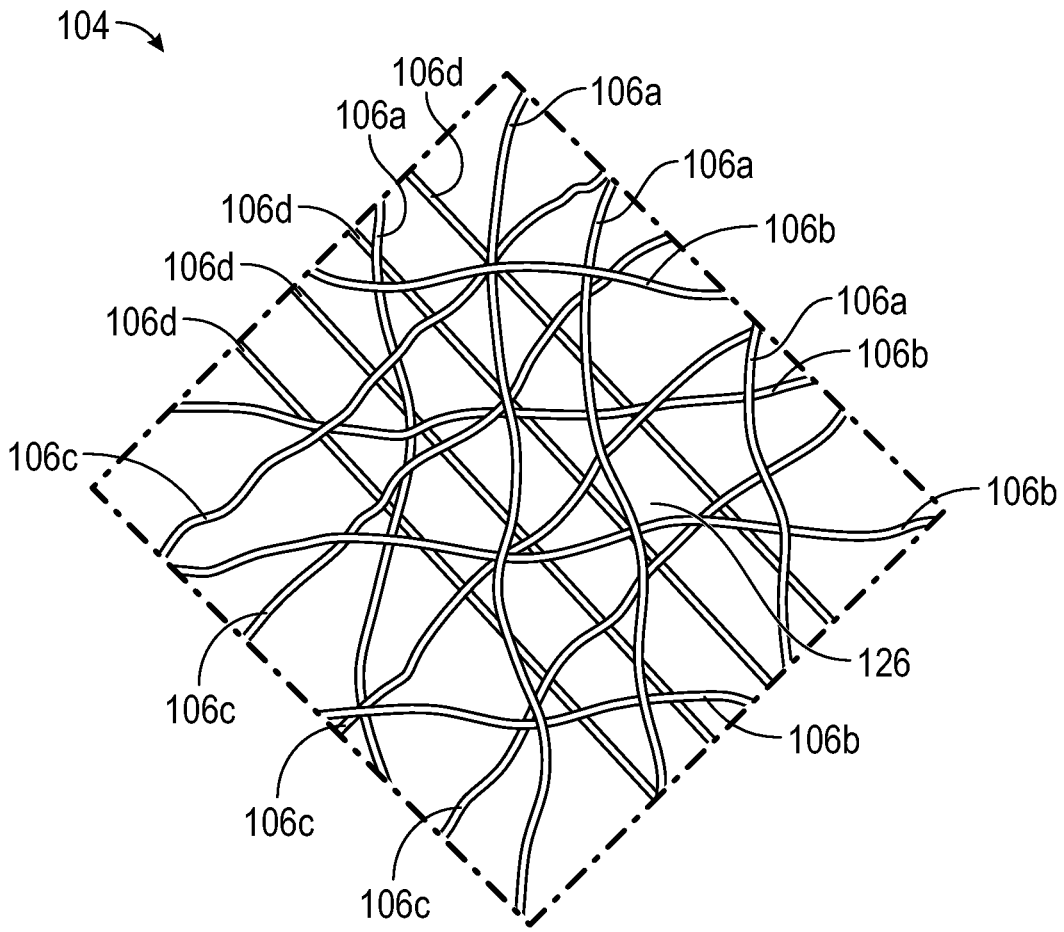
FIG. 13 is a detail view of the upper of the article of footwear, showing the upper with a fourth force applied thereto.

FIG. 10 shows a first state in which a tensile force is applied to the upper 104 in a direction parallel to the first strands 106*a*. In the first state, the first strands 106*a* are in the engaged state and the strands 106*b*-106*d* are in the relaxed state. FIG. 11 shows a second state in which a tensile force is applied to the upper 104 in a direction parallel to the second strands 106*b*. In the second state, the second strands 106*b* are in the engaged state and the strands 106*a*, 106*c*, and 106*d* are in the relaxed state. FIG. 12 shows a third state in which a tensile force is applied to the upper 104 in a direction parallel to the third strands 106*c*. In the third state, the third strands 106*c* are in the engaged state and the strands 106*a*, 106*b*, and 106*d* are in the relaxed state. FIG. 13 shows a fourth state in which a tensile force is applied to the upper 104 in a direction parallel to the fourth strands 106*d*. In the fourth state, the fourth strands 106*d* are in the engaged state and the strands 106*a*-106*c* are in the relaxed state.

The support members 106 can be oriented at various angles relative to each other. For example, in some embodiments, the first strands 106*a* and the second strands 106*b* can intersect at an angle between 70-110 degrees or more particularly at an angle between 80-100 degrees. In particular embodiments, the first strands 106*a* and the second strands 106*b* intersect at an angle of 90 degrees. In some embodiments, the first strands 106*a* and the third strands 106*c* intersect at an angle between 25-65 degrees or more particularly at an angle between 25-55 degrees. In some embodiments, the first strands 106*a* and the third strands intersect at an angle of 45 degrees. In some embodiments, the first strands 106*a* and the fourth strands 106*d* intersect at an angle between 25-65 degrees or more particularly at an angle between 25-55 degrees. In some embodiments, the first strands 106*a* and the fourth strands 106*d* intersect at an angle of 45 degrees.

Figure 14:
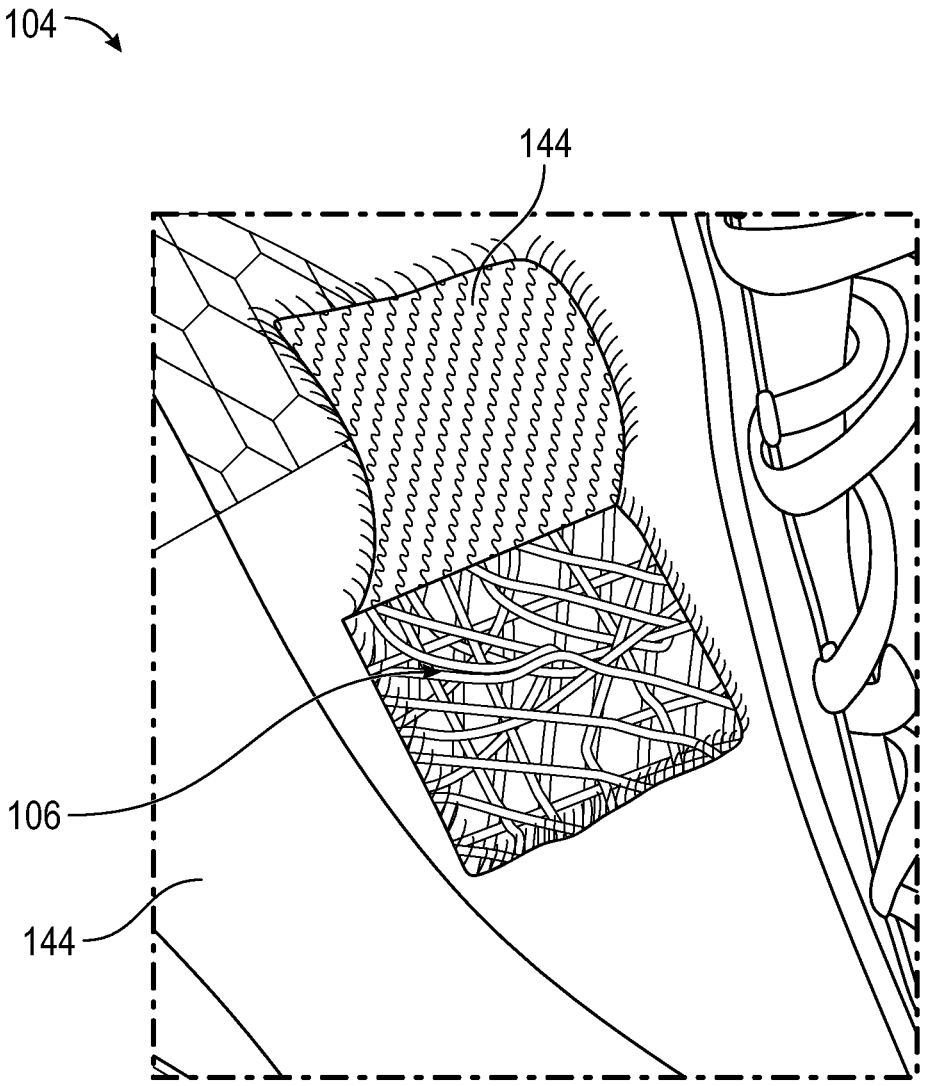
FIG. 14 is a detail view of the upper showing a cover partially torn away to show the support members and base layer of the upper.

As shown in FIG. 14, in some embodiments, the upper 104 can further comprise a cover 144. The cover 144 can be configured to extend over the base layer 126 and the support members 106. In this manner, the cover 144 can prevent the support members from snagging. In such embodiments, the intermediate portions of the support members can "float" between the base layer 126 and the cover 144. In some embodiments, the cover 144 can be a thin flexible component. In some embodiments, the cover 144 can be transparent.

Although the illustrated embodiments show strands oriented in four directions, other embodiments may have strands oriented in more or less than four directions. Also, in some embodiments, an article of footwear can have support members disposed on only one portion of the upper (e.g., a toe portion) and have one or more other portions without support members (e.g., a heel portion).

In view of the many possible embodiments to which the principles of the disclosure may be applied, it should be recognized that the illustrated embodiments are only examples and should not be taken as limiting the scope of the claims. Rather, the scope of the claimed subject matter is defined by the following claims and their equivalents.

The invention claimed is:

1. An article of footwear comprising:

a sole structure; and an upper coupled to the sole structure, wherein the upper comprises:

a toe portion, a side portion, and a heel portion;

a base layer having a peripheral portion; and a plurality of support members that are interwoven, each of the plurality of support members comprising end portions and an intermediate portion extending between the end portions, wherein each of the end portions of the plurality of support members are coupled to the peripheral portion of the base layer, wherein each of the intermediate portions of the plurality of support members intersect with one or more other ones of the plurality of support members and is independently movable between a relaxed, first state and a second state relative to the one or more other ones of the plurality of support members, wherein the intermediate portions of a first grouping of support members of the plurality of support members are in the second state, are oriented in a first axial direction, and comprise a first tension when the base layer is stretched from a relaxed, initial state to a first stretched state, wherein the intermediate portions of a second grouping of support members of the plurality of support members are in the first state, are oriented in a second axial direction, and comprise a second tension when the base layer is stretched from the initial state to the first stretched state, wherein the second tension of the second grouping of support members is less than the first tension of the first grouping of support members, wherein the first axial direction and the second axial direction intersect with each other, wherein a first point of the intermediate portion of each of the second grouping of support members intersects with the intermediate portion of one or more of the first grouping of support members when the base layer is in the initial state, and wherein a second point of the intermediate portion of each of the second grouping of support members intersects with the intermediate portion of the one or more of the first grouping of support members when the base layer is in the first stretched state, wherein support members of the first grouping of support members are non-uniformly spaced apart in the second axial direction, and wherein support members of the second grouping of support members are non-uniformly spaced apart in the first axial direction, wherein the base layer and the plurality of support members are disposed on the side portion, wherein the side portion includes a first region disposed towards the heel portion, a second region disposed towards the toe portion, and a third region disposed between the first and second regions, wherein a greater number of support members of the first grouping of support members are disposed in the first region than in the third region, and wherein a greater number of support members of the second grouping of support members are disposed in the second region than in the third region.

2. The article of footwear of claim 1, wherein the plurality of support members includes a third grouping of support members oriented in a third axial direction, and a fourth grouping of support members oriented in a fourth axial direction, and wherein the first axial direction, the second axial direction, the third axial direction, and the fourth axial direction intersect with each other.

3. The article of footwear of claim 2, wherein the first axial direction and the second axial direction intersect at an angle between 70-110 degrees.

4. The article of footwear of claim 2, wherein the third axial direction and the fourth axial direction intersect at an angle between 70-110 degrees.

5. The article of footwear of claim 2, wherein the first axial direction and the third axial direction intersect at an angle between 25-65 degrees.

6. The article of footwear of claim 2, wherein the first axial direction and the fourth axial direction intersect at an angle between 25-65 degrees.

7. The article of footwear of claim 2, wherein the first grouping of support members is configured to limit elastic deformation of the base layer in the first axial direction when the first grouping of support members is in the second state and the base layer is in the first stretched state.

8. The article of footwear of claim 1, wherein the base layer and the plurality of support members are disposed on the toe portion.

9. The article of footwear of claim 1, wherein the side portion comprises a lateral side portion.

10. The article of footwear of claim 1, wherein the side portion comprises a medial side portion.

11. The article of footwear of claim 1, wherein the base layer and the plurality of support members are disposed on the heel portion.

12. The article of footwear of claim 1, wherein the peripheral portion of the base layer includes a bite line portion and a vamp portion.

13. An article of footwear comprising:

a sole structure; and an upper coupled to the sole structure, wherein the upper comprises:

a toe portion, a heel portion, and a side portion;

a base layer, wherein the base layer is elastically deformable from a relaxed, first state to a second state when a first force is applied to the base layer; and a plurality of support members that are interwoven comprising fixed portions coupled to the base layer and floating portions movable relative to the base layer, wherein the plurality of support members are independently movable relative to one or more other ones of the plurality of support members and configured to limit elastic deformation of the base layer, wherein the plurality of support members comprise a first grouping of support members oriented in a first axial direction and including a first support member and a second grouping of support members oriented in a second axial direction and including a second support member, wherein the first axial direction and the second axial direction intersect, wherein a floating portion of the first support member intersects with a floating portion of the second support member, wherein the first support member has a first tension when the base layer is in the first state and a second tension when the base layer is in the second state, wherein the second tension is greater than the first tension, wherein the second support member has a third tension when the base layer is in the second state, and wherein the third tension is less than the second tension, wherein the base layer and the plurality of support members are disposed on the side portion, wherein the side portion includes a first region disposed towards the heel portion, a second region disposed towards the toe portion, and a third region disposed between the first and second regions, wherein support members of the first grouping of support members disposed in the first region are non-uniformly spaced apart in the second axial direction, wherein a greater number of support members of the first grouping of support members are disposed in the first region than in the third region, wherein support members of the second grouping of support members disposed in the second region are non-uniformly spaced apart in the first axial direction, and wherein a greater number of support members of the second grouping of support members are disposed in the second region than in the third region.

14. The article of footwear of claim 13, wherein the base layer is elastically deformable in a plurality of directions.

15. The article of footwear of claim 13, wherein the base layer is elastically deformable from the first state to a third state when a second force is applied to the base layer, wherein the first support member has a fourth tension when the base layer is in the third state, wherein the fourth tension is less than the second tension, wherein the second support member has a fifth tension when the base layer is in the third state, and wherein the fifth tension is greater than the fourth tension.

16. The article of footwear of claim 15, wherein the fifth tension is greater than the third tension.

17. An article of footwear comprising:

a sole structure;

a base layer coupled to the sole structure, wherein the base layer is elastically deformable from a relaxed, first state to a second state when one or more forces are applied to the base layer, wherein the base layer includes a toe portion, a side portion, and a heel portion;

a first plurality of support member members oriented in a first axial direction coupled to the base layer and including a first support member, wherein when the base layer is in the second state, the first support member comprises a first tension; and a second plurality of support member members oriented in a second axial direction coupled to the base layer and including a second support member, wherein when the base layer is in the second state, the second support member comprises a second tension, and wherein the second tension is less than the first tension, wherein the first axial direction and the second axial direction intersect, wherein the first support member intersects a first portion of the second support member when the base layer is in the first state, wherein the first support member intersects a second portion of the second support member when the base layer is in the second state, wherein the side portion of the base layer includes a first region disposed towards the heel portion, a second region disposed towards the toe portion, and a third region disposed between the first region and the second region, wherein support members of the first plurality of support members are non-uniformly spaced apart in the second axial direction, wherein a greater number of support members of the first plurality of support members are disposed in the first region than in the third region, wherein support members of the second plurality of support members are non-uniformly spaced apart in the first axial direction, and wherein a greater number of support members of the second plurality of support members are disposed in the second region than in the third region.

18. The article of footwear of claim 17, wherein the first plurality of support members and the second plurality of support members are interwoven.

* * * * *